US007311359B2

(12) United States Patent
Smith

(10) Patent No.: US 7,311,359 B2
(45) Date of Patent: Dec. 25, 2007

(54) MANUAL ZERO GRAVITY RECLINING CHAIR WITH ADJUSTABLE BACK ANGLE

(75) Inventor: Nathaniel Smith, Holliston, MA (US)

(73) Assignee: Nepsco, Inc., Lexington, MA (US)

( * ) Notice: Subject to any disclaimer, the term of this patent is extended or adjusted under 35 U.S.C. 154(b) by 141 days.

(21) Appl. No.: 11/170,955

(22) Filed: Jun. 30, 2005

(65) Prior Publication Data

US 2007/0001499 A1 Jan. 4, 2007

(51) Int. Cl.

| | |
|---|---|
| ***A47C 1/024*** | (2006.01) |
| ***A47C 1/032*** | (2006.01) |
| ***A47C 1/06*** | (2006.01) |
| ***A61G 15/04*** | (2006.01) |

(52) U.S. Cl. ..... 297/354.12; 297/68; 297/354.1; 297/354.13; 297/362.13

(58) Field of Classification Search ..... 297/362.13, 297/362.12, 340, 354.1, 351.12, 354.13, 297/68, 354.12

See application file for complete search history.

(56) References Cited

U.S. PATENT DOCUMENTS

| | | | | |
|---|---|---|---|---|
| 825,984 | A | 7/1906 | Schmersahl | |
| 3,235,304 | A | 2/1966 | Glass | |
| 3,934,932 | A * | 1/1976 | Ekornes | 297/354.13 X |
| 4,092,041 | A | 5/1978 | Landry et al. | |
| 4,370,001 | A * | 1/1983 | Ornberg | 297/362.13 |
| 4,768,829 | A | 9/1988 | Goldman | |
| 4,790,599 | A | 12/1988 | Goldman | 297/68 X |
| 5,102,193 | A * | 4/1992 | Goss et al. | 297/362.13 |
| 5,120,107 | A * | 6/1992 | Rogers, Jr. | 297/68 |
| 5,498,055 | A | 3/1996 | Goldman | 297/362.13 |
| 5,857,739 | A * | 1/1999 | Smith | 297/68 X |
| 5,868,461 | A * | 2/1999 | Brotherston | 297/362.13 X |
| 5,931,535 | A * | 8/1999 | Sweet | 297/354.13 |
| 6,065,806 | A * | 5/2000 | Miyaguchi et al. | 297/362.13 |
| 6,089,593 | A * | 7/2000 | Hanson et al. | 297/68 X |
| 6,135,554 | A * | 10/2000 | Tsun et al. | 297/68 X |
| 6,227,489 | B1 * | 5/2001 | Kitamoto et al. | 297/68 X |
| 6,416,131 | B1 * | 7/2002 | Changkeun | 297/362.13 X |
| 6,491,342 | B1 * | 12/2002 | Smith | 297/68 |
| 6,557,942 | B1 * | 5/2003 | Shieh | 297/68 X |
| 6,846,042 | B2 * | 1/2005 | Hanson et al. | 297/68 X |
| 6,902,238 | B1 * | 6/2005 | Abt et al. | 297/362.13 |
| 6,945,596 | B2 * | 9/2005 | Huang | 297/68 |
| 7,011,362 | B1 * | 3/2006 | Huang | 297/354.1 X |
| 7,134,713 | B1 * | 11/2006 | Tseng | 297/68 |

* cited by examiner

*Primary Examiner*—Rodney B. White
(74) *Attorney, Agent, or Firm*—Wilmer Cutler Pickering Hale and Dorr

(57) ABSTRACT

A zero gravity chair generally holds an occupant in a position where the angle between the legs and the torso may be greater than 90 degrees. Typically, the legs may also be elevated such that the legs are even with or above a user's heart. The disclosed zero gravity chair, in some embodiments, enables the backrest portion to pivot relative to the seat portion allowing the user to adjust an angle between the seat portion and the backrest portion. The disclosed zero gravity chair further enables both the backrest and the seat portions to pivot as a unit independent of the angle adjustment. In certain embodiments, the chair also rotates 360 degrees about a vertical axis.

12 Claims, 9 Drawing Sheets

MANUAL ZERO GRAVITY RECLINING CHAIR WITH ADJUSTABLE BACK ANGLE

BACKGROUND OF THE INVENTION

The present invention relates to furniture. More particularly, this invention relates to chairs for positioning individuals in relaxing, comfortable, and/or healthful positions and to methods for making the same.

Chairs have existed for some time. More recently, relatively speaking, chairs that pivot and chair backs that fold have been developed. Another improvement consists of some form of leg support while a chair is in a reclined position. A particular type of reclining chair is a zero gravity chair.

The term zero gravity positioning relates to the orientation of the legs above the level of the heart. It is also called the "90-90" position and the Trendleberg position. The latter term is commonly used in hospitals when a bed is positioned with the legs elevated in order to reduce tension and improve blood circulation. The term "zero gravity," or "Z.G.," stems from suggestions that the human body naturally assumes a similar orientation with respect to the legs when relaxed and suspended in weightlessness. A zero gravity chair attempts to position its occupant in an orientation where the legs may be even with or above the human heart.

Most zero gravity chairs use a fixed relationship between a seat and a back which hold the user in a preset open angular position. An open position, where the angle between the legs and the torso is greater than 90 degrees, may be a beneficial part of zero gravity positioning when the user is reclined. The open angle helps to insure that discs in a user's back are not compressed which may cause back discomfort and possibly damage over time. However, the human body varies in shape from person to person, and thus, the optimum open angle for each person also may be different. Furthermore, a manufacturer's predefined open angle may not always be a comfortable open angle when the zero gravity chair backrest is in the upright position and the seat is level or near level. In the upright position, a smaller angle between the seat and backrest may be preferred. For example, the user may be reading or conversing with the backrest forward and a smaller angle than that of a typical zero gravity chair can provide greater back support and comfort. With a fixed relationship between the seat and the back, as is typical of a zero gravity chair, a difficulty arises in providing both an optimal zero gravity open angle as well as an optimal upright open angle.

Another issue with a fixed open angle positioning is that users of most zero gravity chairs may feel as though they are sliding forward when the chair is in the upright position. A larger fixed open angle of a typical zero gravity chair may cause many users to actually slouch because the predefined open angle may not hold the user comfortably in the seat. Further, because the body weight of the user may have slid forward, many users of a manual zero gravity chair with a fixed open angle may find the chair difficult to operate because the center of gravity of the user is not properly positioned in the chair.

It is therefore an object of the invention to provide a manual zero gravity chair with an adjustable backrest in relation to the seat section of the zero gravity chair. Another object of the invention is to provide the zero gravity chair with a user adjustable backrest independent of the various zero gravity positions the chair is capable of allowing.

SUMMARY OF THE INVENTION

In accordance with the present invention, chairs, and methods for constructing a chair, for comfortably positioning a person are presented. The zero gravity chair, in accordance with some embodiments of the present invention, features a backrest portion that pivots relative to the seat portion of a chair and with the backrest and a seat which rotate together about a horizontal axis. In certain embodiments, the chair rotates 360 degrees about the base.

Thus, in accordance with the present invention, certain embodiments feature a seat frame, a backrest frame connected to a motion bracket by a pivot structure so that the backrest frame may pivot relative to the seat frame, the seat frame attached to the motion bracket and the motion bracket providing a motion bracket pivot structure for the backrest frame and the seat frame to rotate about a motion bracket pivot axis and a side independent of backrest pivoting movements and motion bracket pivoting movements.

Further in accordance with the present invention, certain embodiments feature forming a chair structure, composed of a backrest frame and a seat frame, the backrest frame being connected to the seat frame such that an open angle between the backrest frame and the seat frame is adjustable, connecting the backrest frame and the seat frame to a motion bracket, attaching the motion bracket to a side of the chair, the motion bracket having a motion bracket pivot axis about which the backrest frame and seat frame rotate and attaching the side of the chair to an undercarriage and joining the undercarriage with a swivel mechanism, the swivel mechanism allowing the chair to rotate 360 degrees about a vertically directed axis.

Still further in accordance with the present invention, certain embodiments feature a mechanism for allowing the seat frame and backrest frame to rotate or to hold a position as a unit, a mechanism for providing the backrest frame to pivot or to hold a position relative to the seat frame and a mechanism for applying a force to push the backrest frame to an upright position.

BRIEF DESCRIPTION OF THE DRAWINGS

The above and other features and advantages of the present invention will be apparent upon consideration of the following detailed description, taken in conjunction with the accompanying drawings, in which like reference characters refer to like parts throughout, and in which.

DETAILED DESCRIPTION OF THE INVENTION

In accordance with the present invention, apparatus and methods for comfortably positioning a person in a chair are presented. A zero gravity chair generally holds an occupant in a position where the angle between the legs and the torso may be greater than 90 degrees. Typically, when the chair is in the zero gravity position, the legs are elevated such that the legs are even with or above the occupant's heart. The disclosed zero gravity chair provides the occupant with the ability to vary the angle between a seat and a back sections and to rotate the seat and the back section together as a unit about a horizontal axis.

Figure 1:
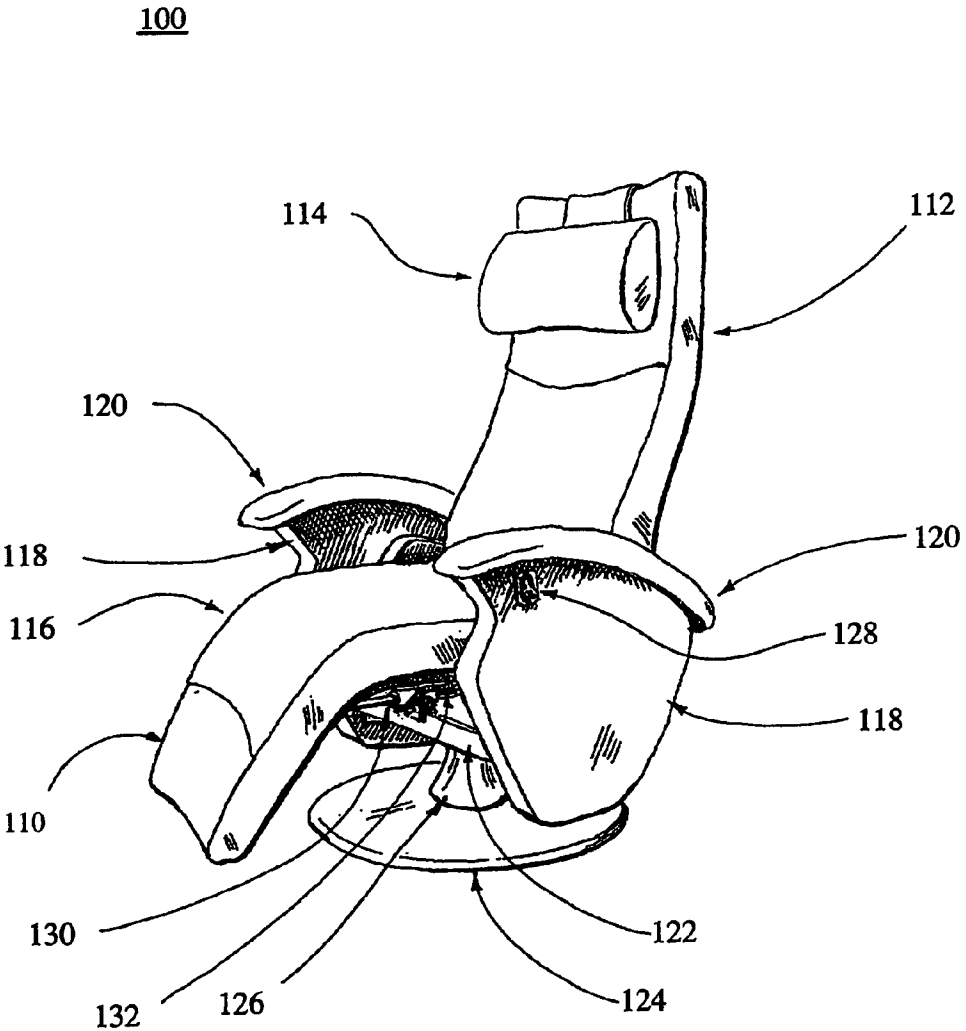
FIG. 1 is a perspective view of a zero gravity chair in accordance with certain embodiments of the present invention.

FIG. 1 illustrates a perspective view of a zero gravity chair in the upright position in accordance with certain embodiments of the present invention. A zero gravity chair 100 includes a backrest 112, an adjustable headrest 114, a seat 116, sides 118, arm pads 120, a center section 122, a base 124, a swivel mechanism 126, a motion controller lever 128, a motion controller 130 and a motion controller cable 132. Backrest 112 may be fully upholstered with a fabric covered foam over a steel frame or any other suitable cushioning substance over a suitable frame in accordance with certain embodiments of the present invention. Adjustable headrest 114 may be strapped to backrest 112 or connected in any other suitable fashion. In certain embodiments, adjustable headrest 114 may be adjusted up and down to enhance user comfort. Seat 116 may be operably connected to backrest 112 such that an open angle between seat 116 and backrest 112 is adjustable. Seat 116 may be fully upholstered with a fabric covered foam material over a steel frame or any other manner in accordance with certain embodiments of the present invention. In certain embodiments, seat 116 is constructed with a footrest 110. Footrest 110 may be integral to the seat or connected through a pivoting connection.

In certain embodiments, backrest 112 as well as seat 116 are supported by sides 118, center section 122, base 124 and swivel mechanism 126. Arm pads 120 are placed on sides 118. Arm pads 120 may be fully upholstered. In some embodiments, arm pads 120 are contoured to allow the occupant's arm to comfortably rest on the arm pad throughout the reclining motion of the chair. Center section 122 holds the two sides together. In some embodiments of the invention, center section 122 may also allow sides 118 to pivot along with seat 116 to provide the user with a more comfortable seating position. Base 124 is connected to swivel mechanism 126 and sufficiently sized to prevent the chair from falling over at any position of swivel. Swivel mechanism 126 is attached to center section 122 and allows the occupant to rotate the chair 360 degrees about base 124. In some embodiments, the user may rotate the chair about base 124 by pushing on the floor with their feet. In other embodiments, a motor may be used to rotate about base 124 of the chair responsive to the user's input.

Motion controller lever 128 activates motion controller 130 through motion controller cable 132. Motion controller 130 allows zero gravity chair 100 to stop and hold a range of positions throughout the recline rotation. In various embodiments, motion controller 130 may be implemented as a sliding lock mechanism, a friction brake, a rack and locking pinion or any other suitable device. Motion controller lever 128 may be implemented, in certain embodiments, as a switch, a knob, a button, a lever or any other suitable mechanism to lock and unlock motion controller 130. In certain embodiments, when motion controller lever 128 is flipped in one direction motion controller 130 is left unlocked until motion controller lever 128 is flipped back in a second direction. By allowing motion controller 130 to remain unlocked with a flip of motion controller lever 128, the user can rotate freely in the chair until motion controller lever 128 is flipped back into the locked position. Thus, in some embodiments, a user activates motion controller 130 by moving motion controller lever 128 while asserting a force perpendicular to backrest 112 thereby causing backrest 112 and seat 116 to rotate into a zero gravity position. Motion controller lever 128 is then released to lock the backrest and seat in the desired position.

Figure 2:
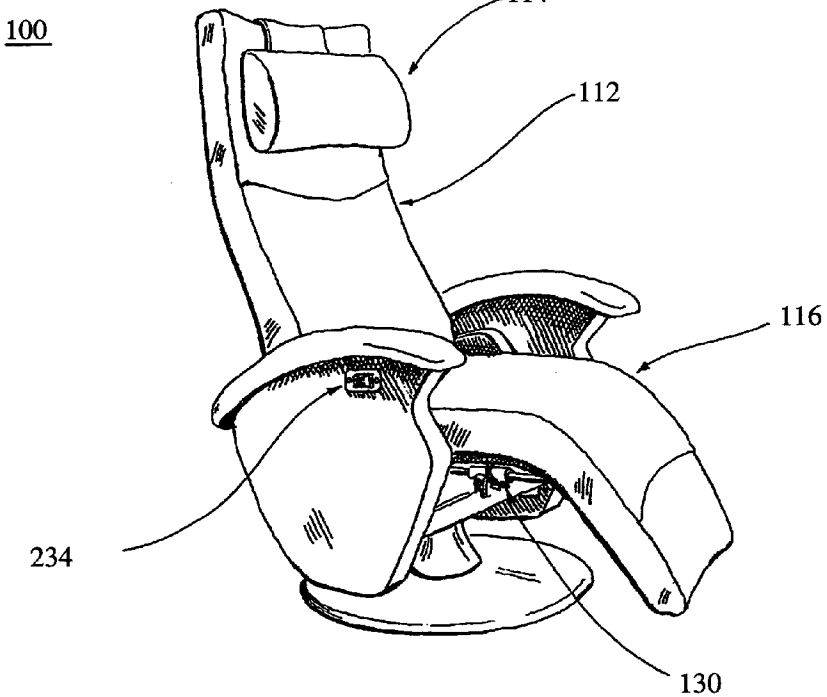
FIG. 2 is a different perspective view of the zero gravity chair in accordance with certain embodiments of the present invention.

A backrest lever 234 that allows user adjustment of backrest 112 of the chair is shown in FIG. 2. FIG. 2 illustrates zero gravity chair 100 in the same position but from another view in accordance with some embodiments of the present invention. Backrest lever 234 activates a later described backrest angle mechanism of zero gravity chair 100. In certain embodiments, backrest lever 234 may be realized as a switch, a knob, a button, a lever or any other suitable device in accordance with certain embodiments of this invention. In some embodiments, when backrest lever 234 is flipped in one direction backrest 112 moves with the user offering support until backrest lever 128 is flipped back in a second direction. When backrest lever 128 is in the second direction, the position of backrest 112 is locked.

Figure 3:
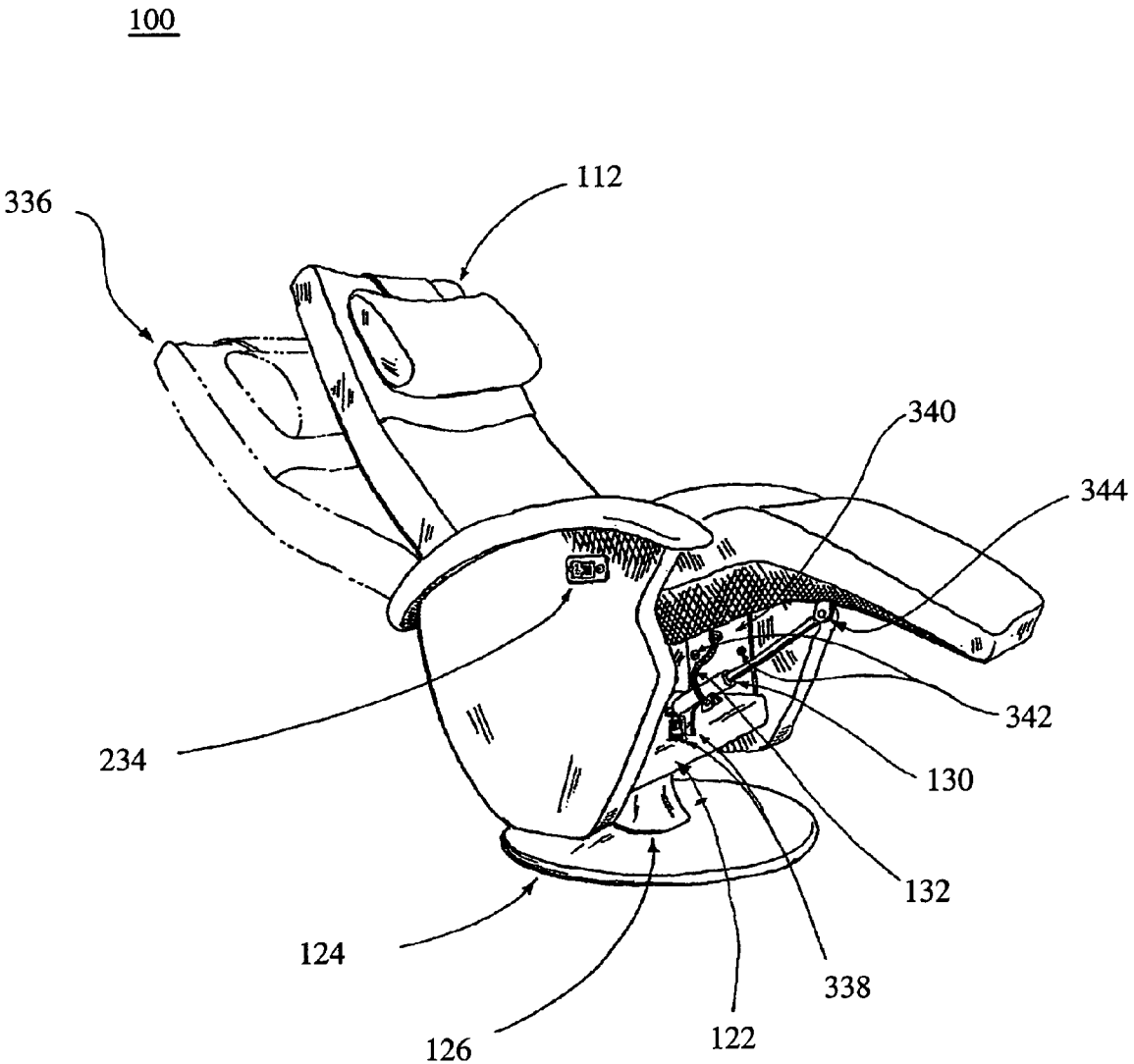
FIG. 3 is a perspective view of the zero gravity chair in a reclined position in accordance with certain embodiments of the present invention.

FIG. 3 illustrates a perspective view of zero gravity chair 100 in a reclined position and shows how backrest 112 may move in accordance with certain embodiments of the current invention. A user may adjust backrest 112 through a range of positions. Phantom line backrest 336 is an illustration of one of many positions backrest 112 may assume. Center section 122 may also connect to the sides of zero gravity chair 100 through undercarriage side plate 340 and bolt 342. Undercarriage side plate 340 may be the steel side of center section 122 if manufactured as one piece or fastened to center section 122 by a weld, bolts or any other device in accordance with this invention. Motion controller 130 is shown in an extended position. Motion controller 130 is connected to chair 100 by tab mounts 338 to center section 122 and by pivot tab 344 to seat 116. Both pivot tab 344 and tab mounts 338 allow motion controller 130 to pivot as the seat rotates. Pivot tab 344 and tab mounts 338 may be made from steel or any other suitable material to fasten motion controller 130 to zero gravity chair 100. Motion controller cable 132 connects motion controller lever 128 to motion controller 130 to allow adjustment of motion controller 130. In certain embodiments, cable 132 may be mechanical. In other embodiments, motion controller cable 132 may be electrical, hydraulic or any other suitable implementation for delivery of user commands to motion controller 130.

Figure 4:
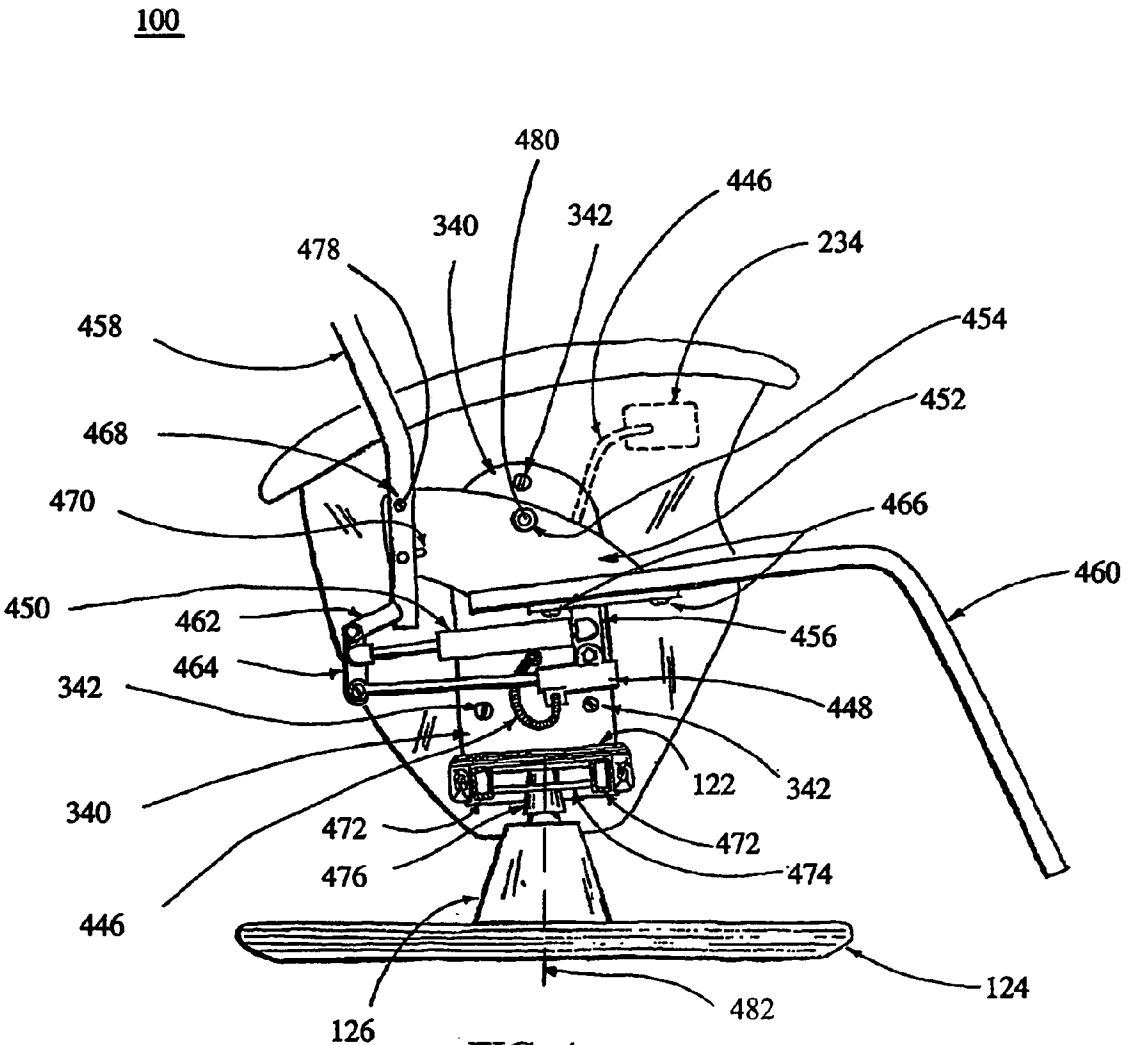
FIG. 4 is a partial view of some internal elements of the zero gravity chair in accordance with certain embodiments of the present invention.

FIG. 4 illustrates a detailed cut-away side view of zero gravity chair 100 showing a mechanism that allows the adjustment of the backrest in accordance with certain embodiments of the invention. The illustrated backrest adjustment mechanism has: backrest lever 234, a backrest cable 446, a backrest controller 448, a gas piston 450, a motion bracket 452, a motion bracket tab 456, a backrest frame 458, a cross bar 462, a cross bar tab 464, a backrest pivot mechanism 468 and a slot 470. Backrest lever 234 connects to backrest controller 448 through backrest cable 446. In certain embodiments, backrest cable 446 may be mechanical. In other embodiments backrest cable 446 may be electrical, hydraulic or any other suitable implementation for delivery of user commands to backrest controller 448. Backrest lever 234 allows the user to change the angle of backrest frame 458 in relation to seat frame 460. When backrest lever 234 is in an unlocked position, the occupant may adjust the angle of backrest frame 458 by the application of pressure or the lack thereof. To push the backrest back, in certain embodiments, the occupant may push towards the back of zero gravity chair 100.

Backrest frame 458 pivots about backrest pivot axis 478 and the adjusting motion may also be guided by slot 470. Slot 470 may be a groove in motion bracket 452 that defines the range of the angular adjustment of backrest frame 458. Slot 470 may also alleviate shearing stresses placed on backrest pivot mechanism 468 by taking some of the pressure off backrest pivot mechanism 468. Backrest frame 458, in certain embodiments, includes cross bars and backrest frame uprights. The backrest frame uprights may be steel bars, tubes, rods or any other material that can provide support and shape for backrest 112. Cross bar 462 may be welded onto the backrest frame uprights or to the backrest frame at any other suitable location. In some embodiments, backrest frame 458 and seat frame 460 may have multiple cross bars. Cross bar tab 464 is connected to cross bar 462 and holds gas piston 450 as well as backrest controller 448. In certain embodiments, cross bar tab 464 may be formed as an integral part of cross bar 462. In other embodiments, cross bar tab 464 may be welded, bolted or otherwise fastened to cross bar 462. Alternatively, cross bar tab 464 may be attached to the backrest frame upright or at any other suitable location.

Motion bracket tab 456 protrudes from motion bracket 452 providing a point of attachment for backrest controller 448 and gas piston 450. Gas piston 450 may be a standard gas piston which, in this case, functions as a spring applying continual force to backrest 112 towards a fully upright position. In other embodiments, a spring or any other suitable mechanism may be used to apply continual force to the backrest. Gas piston 450 serves to readjust backrest 112 when a user unlocks backrest controller 448 and removes reclining pressure against backrest 112. In certain embodiments, gas piston 450 may be designed to help return the user to an upright position when backrest controller 448 is unlocked. Moreover, once returned to an upright position, the user may find it easier to rotate in the zero gravity chair.

Zero gravity chair 100 may also rotate about a vertically directed axis 482 encompassing a 360 degree range of motion, in certain embodiments of the present invention. A swivel functionality may be composed of the following components: swivel mechanism 126, undercarriage section 472, plates 474 and pivot bushing 476. Swivel mechanism 126 defines a center pivot that allows the recliner to spin 360 degrees. In some embodiments, swivel mechanism 126 may be an enclosed bearing, a lubricated sleeve or any other device that permits a 360 degree rotating motion. Attached to swivel mechanism 126 is pivot bushing 476. Pivot bushing 476 attaches the center pivot of swivel mechanism 126 to undercarriage section 472.

In some embodiments, an undercarriage of zero gravity chair 100 may include: center section 122, undercarriage side plate 340, undercarriage section 472 and plates 474. The undercarriage may provide a mounting point to the base of zero gravity chair 100 or may serve as the base in some embodiments. The undercarriage may also serve as a support structure for the zero gravity chair, providing mounting points for the sides and other elements of the zero gravity chair. Plates 474 may be connected to undercarriage section 472 to provide strength to the undercarriage. In other embodiments, plates 474 may be made of steel, a metal alloy, a ceramic, a ceramic alloy or any other suitable material. The plates may also be implemented as cross bars, tubes or any other suitable reinforcing structure. Undercarriage section 472 may include steel tubes, in some embodiments, and connect to plates 474 to center section 122. Undercarriage section 472 may also connect to undercarriage side plate 340 by a weld, a bolt or any other fastening device in accordance with the present invention. Center section 122 serves as a cover for a portion of the undercarriage of zero gravity chair 100. However, in certain embodiments, center section 122 may be a structural member of the chair. If acting as a structural member of zero gravity chair 100, center section 122 may allow construction of the zero gravity chair without the use of plates 474.

Figure 5:
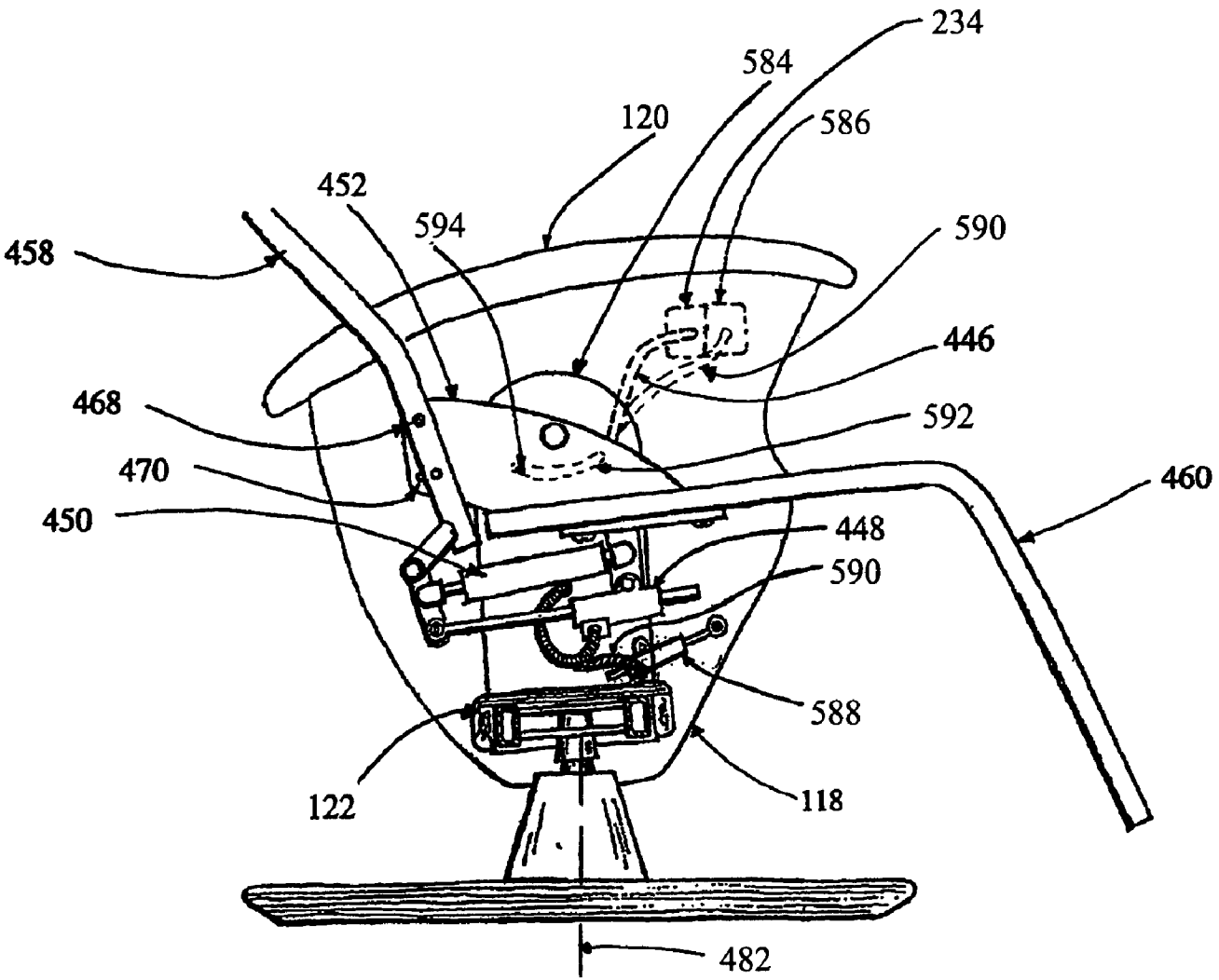
FIG. 5 is partial view of some internal elements that control side movement of the zero gravity chair in accordance with certain embodiments of the present invention.

FIG. 5 is a partial, cut-away, side view of a zero gravity chair showing among other internal elements, a mechanism that allows sides 118 to move, in certain embodiments of the design. In some embodiments, motion bracket 452 is attached to sides 118 so that sides 118 rotate back as the chair rotates back. As shown in FIG. 5, a modified side plate 584 attaches to sides 118 so that sides 118 are adjustable. In certain embodiments, sides 118 are adjustable independent of other movements of the zero gravity chair. A side motion lever 586 is co-located with backrest lever 234. Side motion lever 586 activates a side motion controller 588 through a side motion controller cable 590 to control the adjustment of sides 118. In certain embodiments, the side motion lever may be realized as a switch, a knob, a button, a lever or any other suitable device in accordance with certain embodiments of this invention. Side motion controller 588 may be the same type of device as backrest controller 448, but mounted to sides 118 and center section 122. Two side motion controllers may be used or the two sides may be connected so only one side motion controller is needed. In other embodiments, two side motion controllers may be controlled by one side motion lever. To adjust the sides, in certain embodiments, the user moves the side motion lever to unlock the side motion controller and then presses down or pulls up on arm pads 120.

Figure 6:
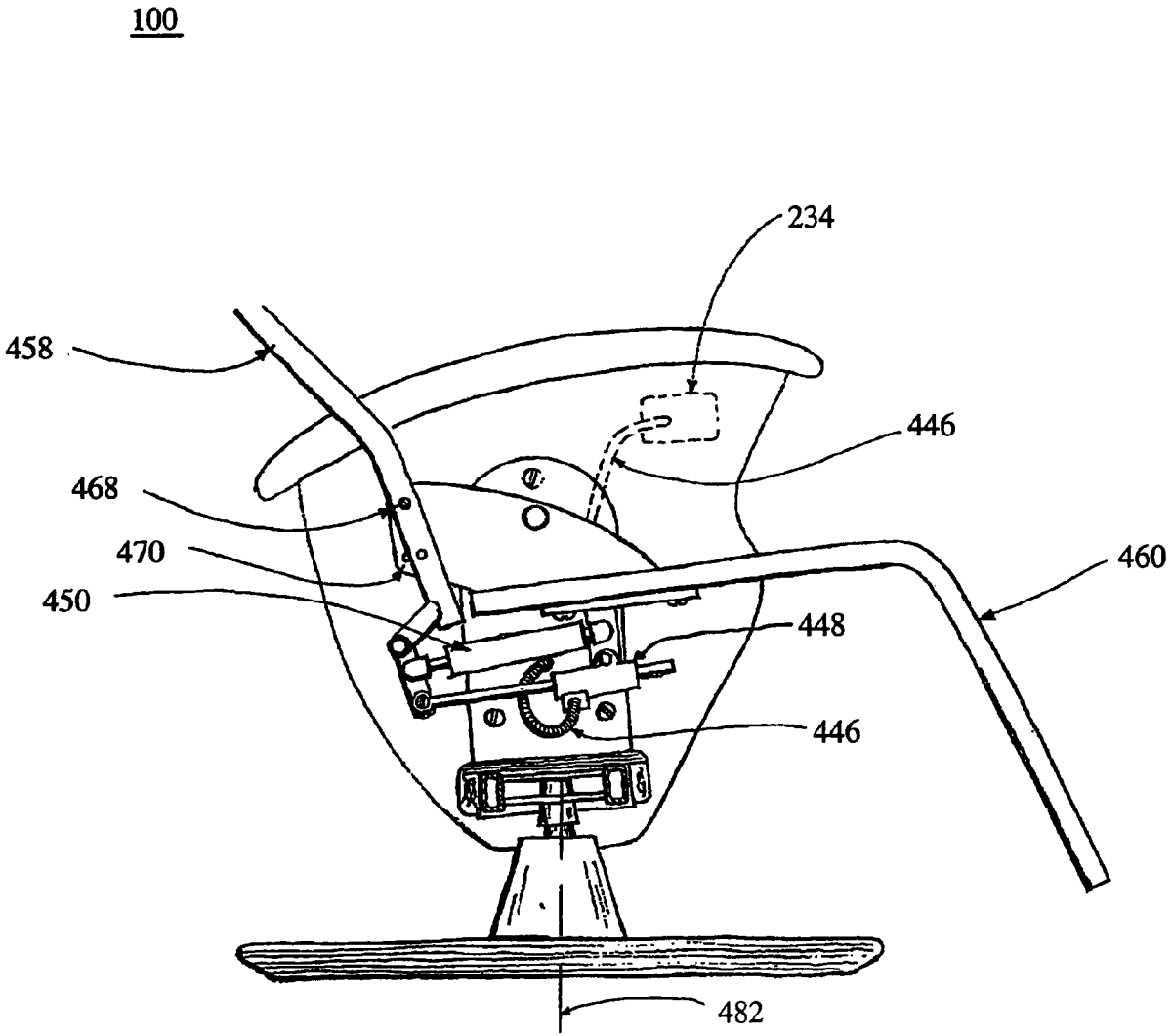
FIG. 6 is a partial view of some internal elements of the zero gravity chair with a backrest frame in a reclined position relative to a seat frame in accordance with certain embodiments of the present invention.

FIG. 6 is a partial, cut-away, side view of zero gravity chair 100 showing the mechanism that allows the adjustment of backrest frame 458 with backrest frame 458 in a more reclined position relative to seat frame 460 in accordance with certain embodiments of the invention. In the more reclined position, gas piston 450 is in a more compressed position. In addition, backrest frame 458 has moved along slot 470 so that an open angle between seat frame 460 and backrest frame 458 is greater than the angle in FIG. 5.

Figure 7:
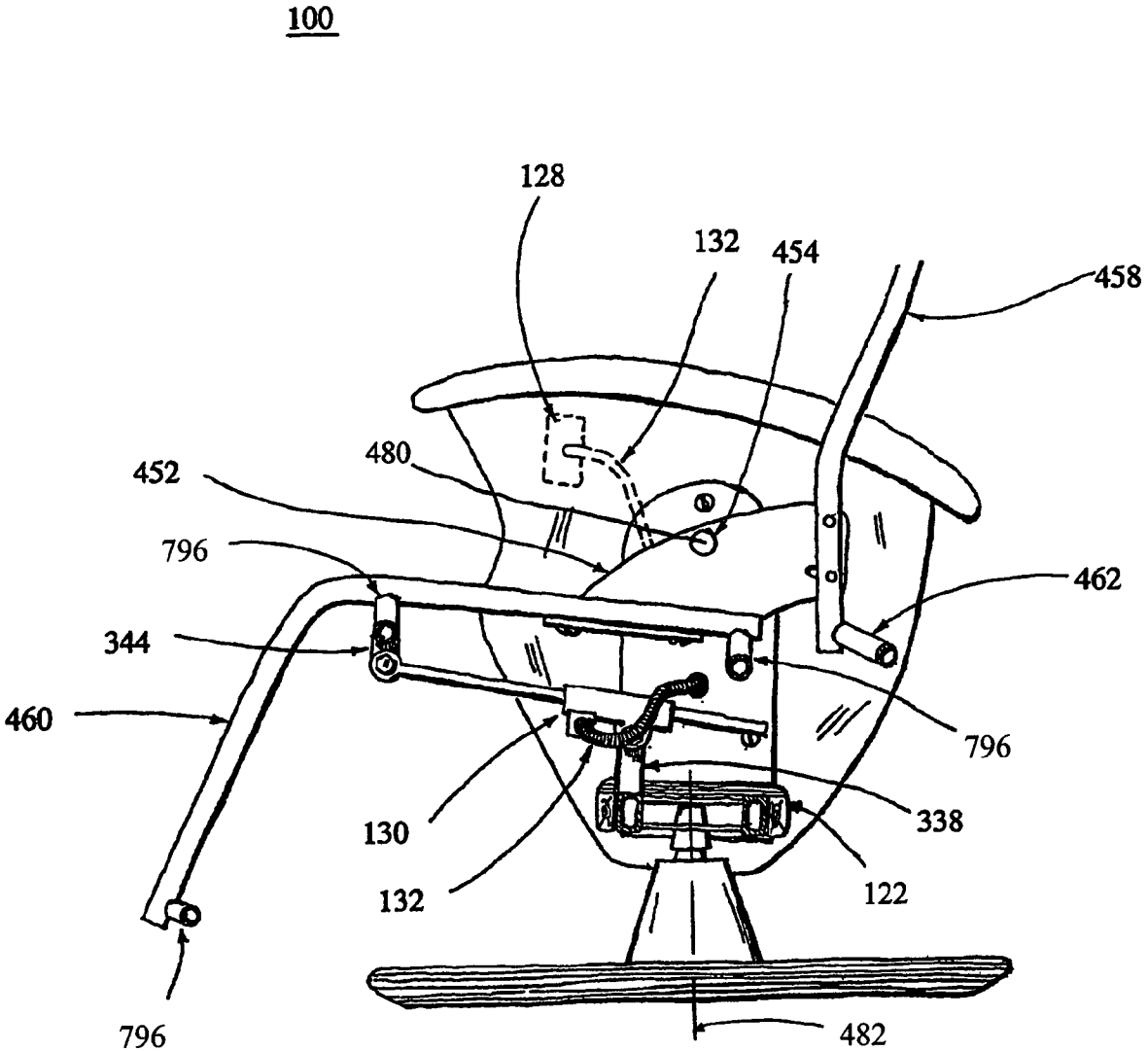
FIG. 7 is another partial view of some internal elements of the zero gravity chair in accordance with certain embodiments of the present invention.

FIG. 7 is an illustration of a partial section, cut-away, side view showing some of the inner components involved in rotating zero gravity chair 100 to a zero gravity position in accordance with certain embodiments of the present invention. Illustrated motion controller 130 holds seat frame 460 and backrest frame 458 in a specified position throughout a rotation about motion bracket pivot axis 480. A user may lock and unlock motion controller 130 using motion controller lever 128. Motion controller 130 is fastened to the steel undercarriage by mounting brackets 338. Mounting brackets 338 may be a part of the undercarriage or attached to the undercarriage by bolts, welds or any other suitable device. Likewise, motion controller 130 may be fastened to mounting brackets 338 and to mounting tab 344 by one of more bolts, welds or pivot mechanisms to allow motion controller 130 to change angle as the chair rotates about motion bracket pivot axis 480 through various positions. Illustrated mounting tab 344 attaches to cross bar 796 or seat frame 460 by a weld, bolt or other suitable fastening device. Cross bar 796, in certain embodiments, is a part of seat frame 460 and connects a right and a left portion of the seat frame together. The right and the left portion of the seat frame may be steel bars, tubes, rods or any other material that can provide support and shape for seat 116 (FIG. 2).

In certain embodiments of the invention, zero gravity chair 100 incorporates a rotation mechanism. As shown in FIGS. 3 and 4, the illustrated rotation mechanism includes motion bracket 452, motion bracket pivot structure 454, undercarriage side plate 340, seat frame 460, backrest frame 458, motion controller 130, motion controller lever 128, motion controller cable 132, tab mounts 338 and pivot tab 344. Seat frame 460 attaches to motion bracket 452 using seat bolts 466, in some embodiments of the invention. In other embodiments, seat frame 460 may be welded to motion bracket 452 or constructed as an integral piece with motion bracket 452. Motion bracket 452 connects seat frame 460 to backrest frame 458. Motion bracket 452 allows a user to recline zero gravity chair 100 by rotating about motion bracket pivot axis 480. As shown in FIG. 7, motion controller 130, which may be attached to seat frame 460 by pivot tab 344 and center section 122 by tab mounts 338, permits locking at a desired rotated position. Motion controller lever 128 controls motion controller 130 through motion controller cable 132. Motion bracket pivot structure 454 may serve as a connection point between motion bracket 452 and undercarriage side plate 340. In certain embodiments, undercarriage side plate 340 may include a slot 592 and motion bracket 452 may include a pin 594. The slot 592 and pin 594 combination shown in FIG. 5 may be used to alleviate pressure from motion bracket pivot structure 454 and can serve as a rotation limiter. Slot 592 is illustrated as a phantom line because the slot is in plate 340 and behind motion bracket 452. In other embodiments, the slot and pin combination may be replaced with a wheel and track, a rack and pinion or any other suitable guidance mechanism.

Figure 8:
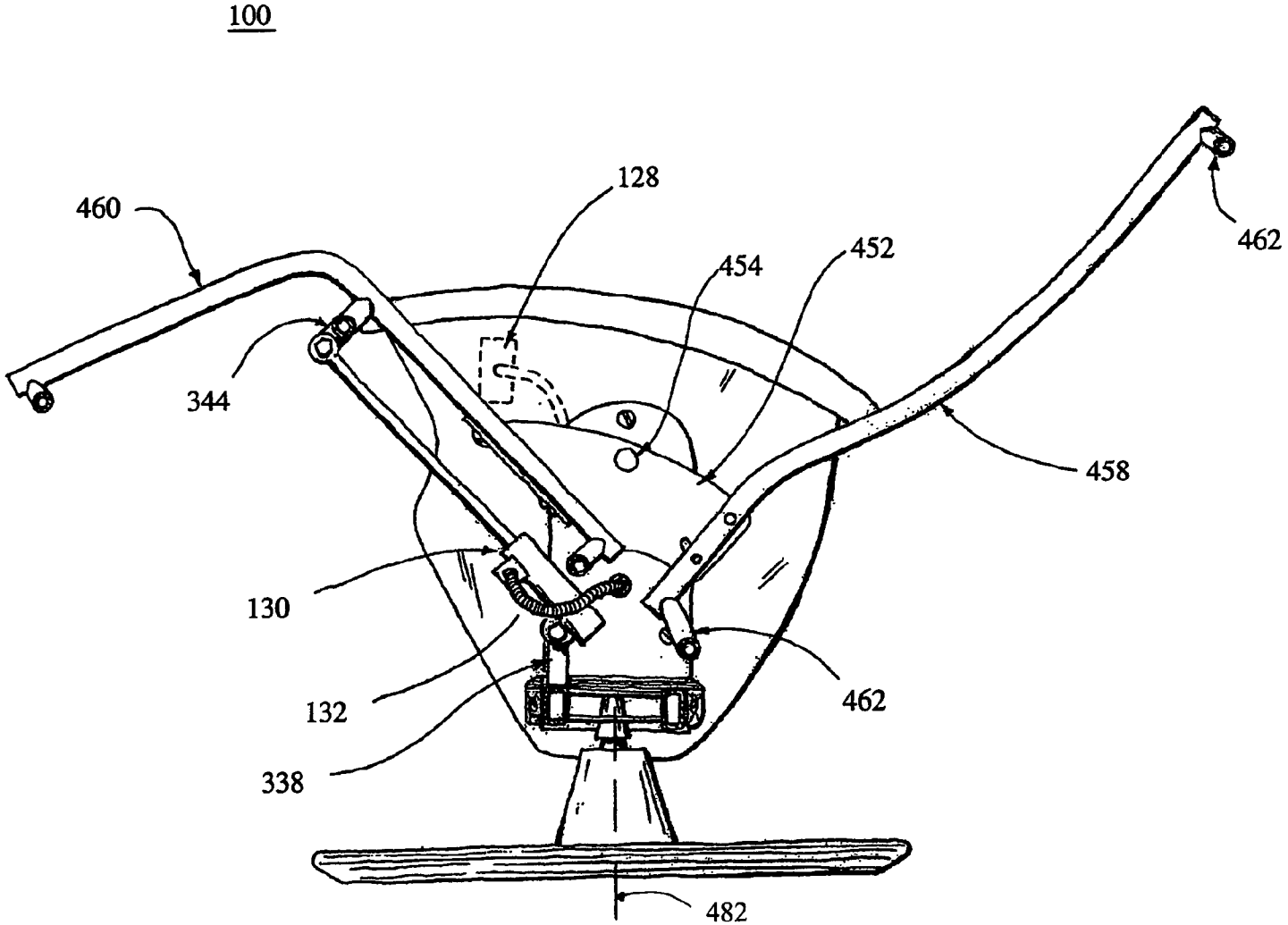
FIG. 8 is a side view of the internal elements of the zero gravity chair with the chair rotated to a zero gravity position in accordance with certain embodiments of the present invention.
Figure 9:
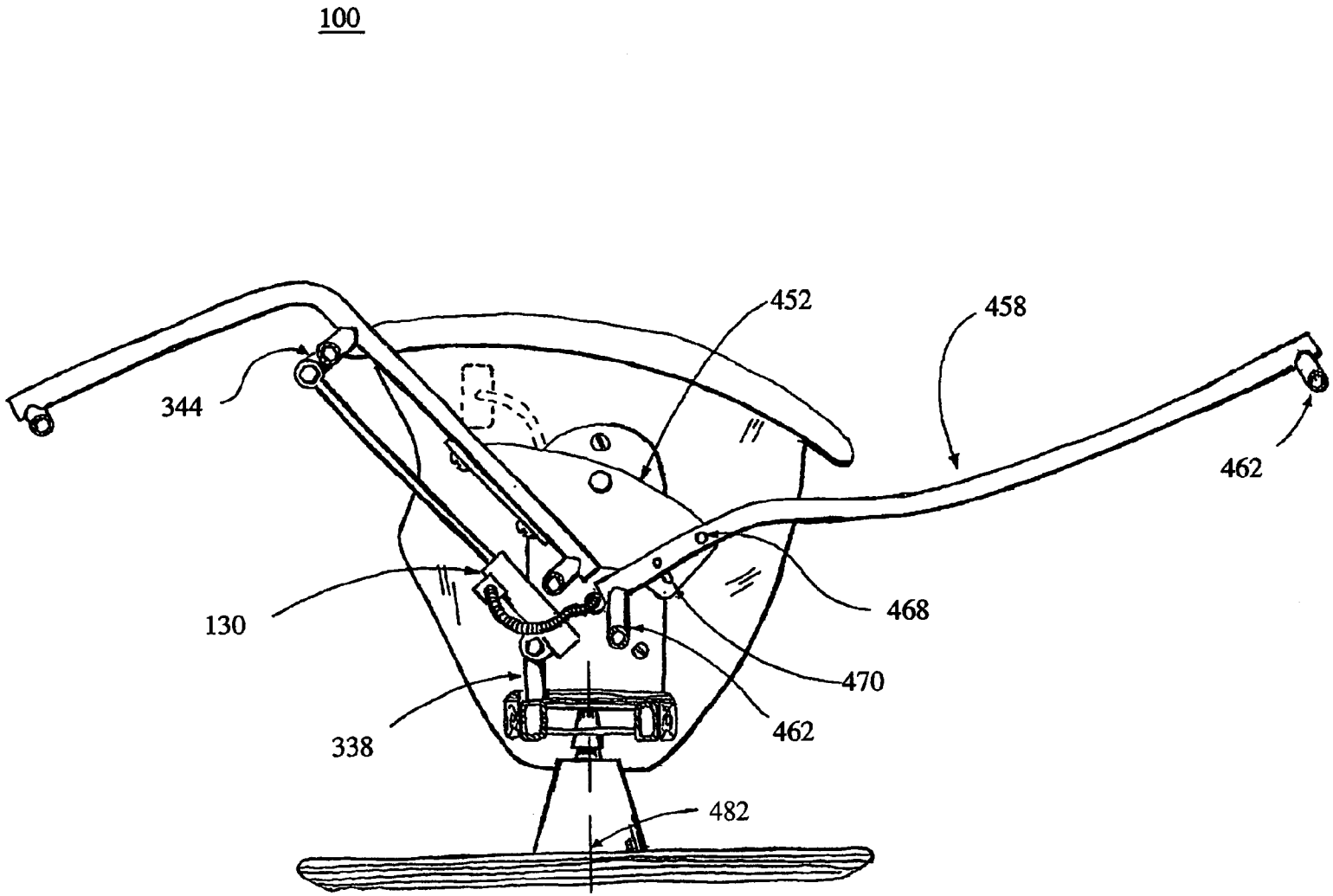
FIG. 9 is an illustration of the internal elements of the zero gravity chair with the backrest frame adjusted differently with respect to the backrest frame shown in FIG. 8 in accordance with certain embodiments of the present invention.

FIG. 8 is a partial cut-away side view of the chair 100 which illustrates some of the inner components of zero gravity chair 100 with the chair in a zero gravity position in accordance with certain embodiments of the present invention. Motion controller 130 is shown in a more extended position. Backrest frame 458 and seat frame 460 are shown with the open angle of the zero gravity chair adjusted to be closer to 90 degrees. Referring to FIG. 9, backrest frame 458 and seat frame 460 are shown with the open angle of the zero gravity chair adjusted to be greater than 90 degrees. As shown in FIGS. 8 and 9, the open angle of zero gravity chair 100 may be adjusted when backrest frame 458 and seat frame 460 are rotated into the zero gravity position.

Other embodiments, extensions, and modifications of the embodiments presented above are within the understanding of one versed in the art upon reviewing the present disclosure. Accordingly, the scope of the present invention in its various aspects should not be limited by the examples presented above. The individual aspects of the present invention, and the entirety of the invention should be regarded so as to allow for design modifications and future developments within the scope of the present disclosure.

What is claimed is:

1. A zero-gravity chair comprising:

a seat frame;

a backrest frame connected to a motion bracket by a first pivot structure; the seat frame attached to the motion bracket and the motion bracket providing a second pivot structure for the backrest frame and the seat frame to rotate about the second pivot structure from an upright position to a recline position; and a lockable backrest controller connected to the motion bracket providing a lockable adjustment of an open angle between the backrest frame and the seat frame;

wherein backrest pivoting movements to adjust the open angle and motion bracket pivoting movements to adjust recline are adjustable and lockable independent of one another.

2. The chair of claim 1, further comprising:

a motion controller attached to the seat frame and a center section to enable the seat frame and backrest frame to hold a position throughout a rotation about the second pivot structure;

a the lockable backrest controller to enable adjustment of an open angle between the backrest frame and the seat frame independent of the rotation of the backrest frame and seat frame about the second pivot structure; and a gas piston applying a force to push the backrest frame to an upright position.

3. The chair of claim 2, wherein the motion controller and the lockable backrest controller are each coupled to a lever which controls locking to hold a position and unlocking to allow movement.

4. The chair of claim 1, further comprising a swivel mechanism allowing the chair to rotate 360 degrees about a vertically directed axis.

5. A method for constructing a zero-gravity chair comprising:

forming a chair structure, composed of a backrest frame and a seat frame, the backrest frame being connected to the seat frame by a first pivot structure such that an open angle between the backrest frame and the seat frame is adjustable;

connecting the backrest frame and the seat frame to a motion bracket;

attaching the motion bracket to a side of the chair, the motion bracket having a second pivot structure about which the backrest frame and seat frame rotate to provide adjustment from an upright position to a recline position and to allow independent adjustment of the chair structure's recline and open angle; and attaching the side of the chair to an undercarriage and joining the undercarriage with a swivel mechanism, the swivel mechanism allowing the chair to rotate 360 degrees about a vertically directed axis.

6. The method of claim 5, further comprising: attaching a motion controller to the seat frame and the undercarriage; and attaching a lockable backrest controller to the backrest frame and to the motion bracket.

7. The method of claim 6, wherein the motion controller and the lockable backrest controller are each coupled to a lever which locks and unlocks the movement of the respective motion controller or lockable backrest controller.

8. A zero-gravity chair comprising:

means for connecting a backrest frame and a seat frame and providing a first pivot structure such that an open angle between the backrest frame and the seat frame is adjustable;

means for holding the backrest frame and the seat frame together and providing a second pivot structure around which the backrest frame and the seat frame can rotate from an upright position to a recline position as a unit independent of the open angle adjustment; and means for swiveling the chair 360 degrees about a vertical axis.

9. The chair of claim 8, further comprising:

means for allowing the seat frame and backrest frame to rotate or to hold a position;

means for providing the backrest frame to pivot or to hold a position relative to the seat frame; and means for applying a force to push the backrest frame to an upright position.

10. The chair of claim 9, wherein the means for allowing is a motion controller.

11. The chair of claim 9, wherein the means for providing is a backrest controller.

12. The chair of claim 8, wherein the means for connecting and the means for holding is a motion bracket.

* * * * *